US005193691A

United States Patent [19]

Chong

[11] Patent Number: 5,193,691

[45] Date of Patent: Mar. 16, 1993

[54] CAN SEAM INSPECTION APPARATUS

[76] Inventor: Wun C. Chong, 69 Wallace Place, Delta, B.C., Canada, V4M 3S2

[21] Appl. No.: 750,162

[22] Filed: Aug. 26, 1991

[51] Int. Cl.[5] ..... B07C 5/00; B07C 5/02

[52] U.S. Cl. ..... 209/600; 209/701; 209/903; 209/912; 209/940

[58] Field of Search ..... 209/538, 597, 598, 600, 209/601, 701, 928, 919, 903, 698, 912, 940, 924, 530, 531, 522, 523, 655; 198/441, 803.9

[56] References Cited

U.S. PATENT DOCUMENTS

| | | | |
|---|---|---|---|
| 2,270,613 | 1/1942 | Young, Jr. | 209/701 X |
| 2,293,586 | 8/1942 | Bardet et al. | 209/597 |
| 2,353,758 | 7/1944 | Peck | 209/655 X |
| 3,313,409 | 4/1967 | Johnson | 209/538 X |
| 4,497,409 | 2/1985 | Chong | 209/538 |

FOREIGN PATENT DOCUMENTS

| | | | |
|---|---|---|---|
| 573206 | 9/1977 | U.S.S.R. | 209/601 |

*Primary Examiner*—Donald T. Hajec

[57] ABSTRACT

A can seam inspection apparatus. The apparatus has a pathway for a can and the pathway having an inlet and a pair of outlets. There is one outlet for can with a defective seam and another outlet for acceptable cans. A releasable holding device holds the cans as the cans move along the pathway. This holding device is rotated as they move along the pathway. The cans rotate with the holding device. The holding device can be released adjacent the inlet and the outlet. The can is inspected, preferably by a roller moving around the seam, as the can rotates. If the can is found defective then the inspection apparatus includes mechanisms to open the first outlet to allow rejection of the can. If the can is acceptable the can rolls over the first outlet to the second outlet. The equipment operates at high speed and with excellent accuracy. It can operate effectively in hostile environments.

14 Claims, 4 Drawing Sheets

CAN SEAM INSPECTION APPARATUS

FIELD OF THE INVENTION

This invention relates to a can seam inspection apparatus.

DESCRIPTION OF THE PRIOR ART

In the canning of food it is essential that the seams of the can be in good order. Canned food can last a remarkably long time provided that the can is sound. Almost invariably the problem comes from the seam which is used as a final closure of the can, that is after the food has been placed in the can. It is extremely important that cans with defective seams be rejected. Improperly canned goods are a notorious source of food poisoning, for example, in extreme cases, botulism.

The oldest system of inspecting cans was simply to have a worker inspect samples of the cans by turning the sampled can in his or her hands. Such an approach is impracticable with increasing speed of production. Modern canning lines operate at great speed.

Equipment to inspect the can automatically was therefore developed. The early equipment was laborious. It normally involved the complete rotation of the inspection equipment round the seams of the top and the bottom of the can to determine that the seams are complete. Nowadays only one seam needs to be inspected at high speed. What may normally be considered the bottom of the can is formed *before* the food is put in the can and is not normally a source of hazard.

To avoid the above disadvantages a seam inspection apparatus was developed as described in my U.S. Pat. No. 4,497,409 issued Feb. 5, 1985.

This apparatus has proved successful but there are certain disadvantages. Inspection is carried out by, for example, a camera. The use of equipment such as cameras, and other electronic equipment required by the above apparatus, in a canning plant is not desirable. The equipment is expected to operate in conditions far from ideal for such equipment.

A further disadvantage of the prior art equipment is that it normally forms a separate step, subsequent to the canning process, and often quite some time subsequent to the canning process. A disadvantage of this is that the food in a defective can cannot be used. The can is rejected and so is the food. It would be preferable to have an apparatus that could be built into the canning line with a minimum interruption of the line so that food from a defective can can be returned to the line.

The errors present in canning include droops, lips, pin-lips, vees and false seams. In general, these terms are descriptive of the shape of the projecting malformation of the underside of the seam that necessitates rejection of the can.

Reasons for the malformation in the seam include product trapped in the seam, hard or brittle plate and improper operation of the apparatus so that the top of the can and the side wall do not hook together properly.

SUMMARY OF THE INVENTION

The present invention provides an apparatus able to carry out a mechanical inspection of the seam. The apparatus is compact and can be suspended, for example, from a ceiling, so that it can be incorporated into a production line with minimum effect on that line and without repositioning any of the existing equipment in the line.

Accordingly, the present invention is a can seam inspection apparatus comprising a pathway for a can, the pathway having an inlet and a pair of outlets comprising a first outlet for cans with a defective seam and a second outlet for acceptable cans, a plurality of releasable holding means to hold cans as the cans move along the pathway, means to rotate the holding means and thus the cans as they move along the pathway, release means to release the holding means at the inlet and adjacent the outlets, means to assess the seam of a can as the can rotates, and means to open the first outlet when the seam is found defective.

Preferably the means to rotate the stations comprises a central fixed first gear wheel. A rotatable second gear wheel is attached to each holding means and engages the first gear wheel. By this means, the holding means is rotated with the second gear wheel as the holding means moves round the first gear wheel while engaged with the first gear wheel.

In a preferred embodiment the releasable holding means comprises opposed plates. A first plate is urged toward a second plate to grip a can. The opposed plates are preferably each mounted on a frame. The first plate is mounted on a rod slidably mounted on the frame and there is a lever to contact the rod at one end of the lever. There is a roller at the distal end of the lever and a track extends around the apparatus to receive the roller. There are deviations in the track. The roller moves to follow the deviations and thus moves the lever to move the first plate to grip or release a can.

The means to assess the seam of a can preferably comprises a roller to contact the seam as the can is rotated. The roller is mounted on a cam shaft and there is a lever contacting the cam shaft. A catch is operable by longitudinal movement of the lever and the rod is retained by the catch. Movement of the roller on contacting a seam defect operates the catch to release the rod. The rod acts to trigger a mechanism which opens the first outlet to allow rejection of a can. In this embodiment, the rod is received in a housing. There are resilient means to urge the rod outwardly of the housing and an abutment on the rod engages the catch. Movement of the catch from the abutment allows the resilient means to urge the rod outwardly of the housing.

BRIEF DESCRIPTION OF THE DRAWINGS

The invention is illustrated, by way of example, in the drawings, in which.

DESCRIPTION OF THE PREFERRED EMBODIMENT

Figure 1:
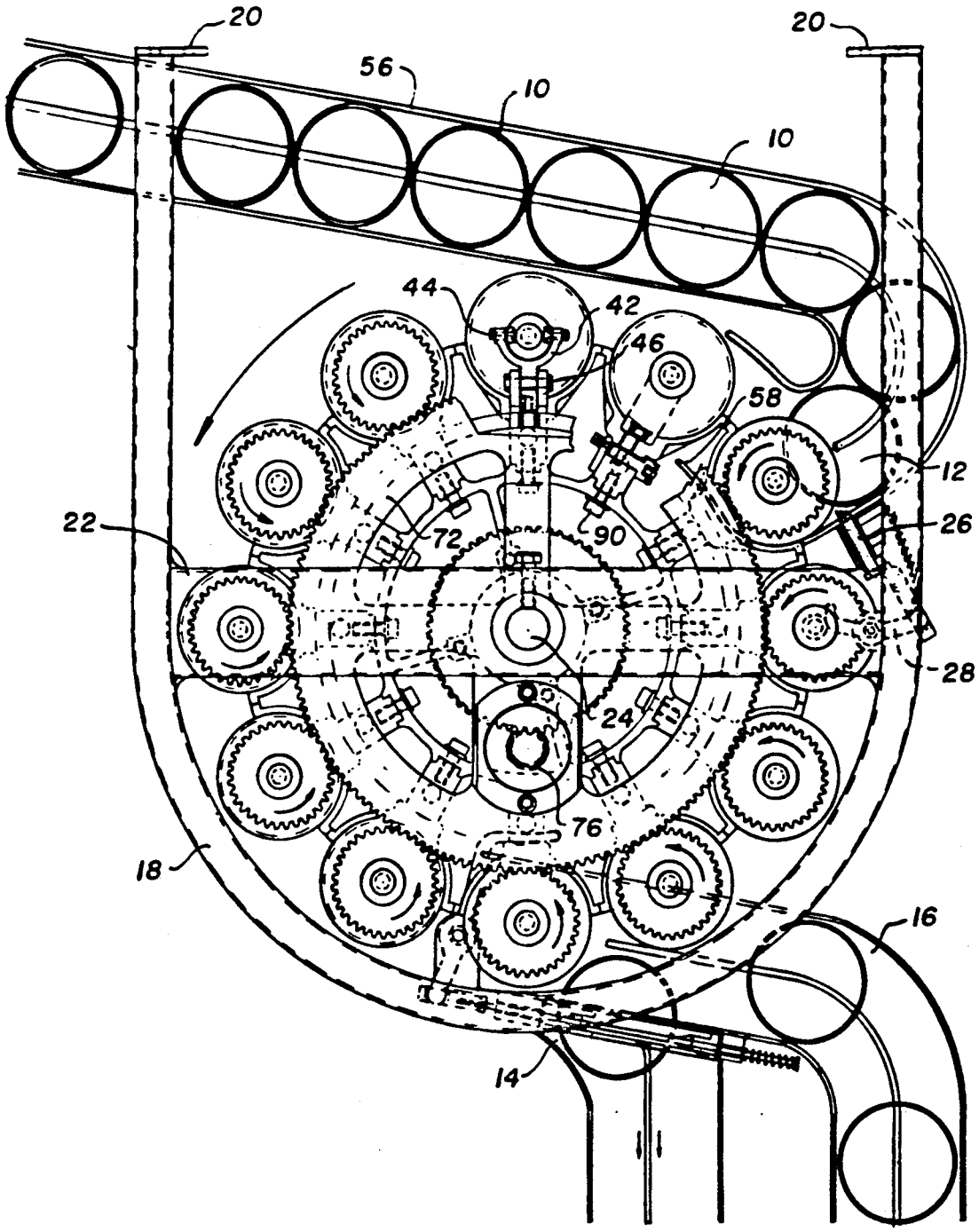
FIG. 1 is a side elevation of the apparatus according to the present invention.

In the drawings a can seam inspection apparatus comprises a generally circular pathway for a can 10. The pathway has an inlet 12 and a pair of outlets 14 and 16. The apparatus is mounted on a frame 18 that can be suspended from a ceiling at 20, and having cross members 22. A central shaft 24 extends between opposed cross members 22.

The inlet 12 is controlled to permit the orderly passage of one can 10 in time with the arrival of a releasable holding means for the can. As shown in FIG. 1, the inlet 12 is controlled by a gate projecting into the inlet. There is a spring urging the gate 26 to a position where it blocks the inlet 12, as shown in FIG. 1. However, the gate 26 is attached to a pivotally mounted lever 28 which contacts releasable holding means for a can 10 as the releasable holding means approaches the inlet 12. The lever 28 contacts the releasable holding means to retract the gate 26 to allow a can 10 to be received by the releasable holding means.

Figure 2:
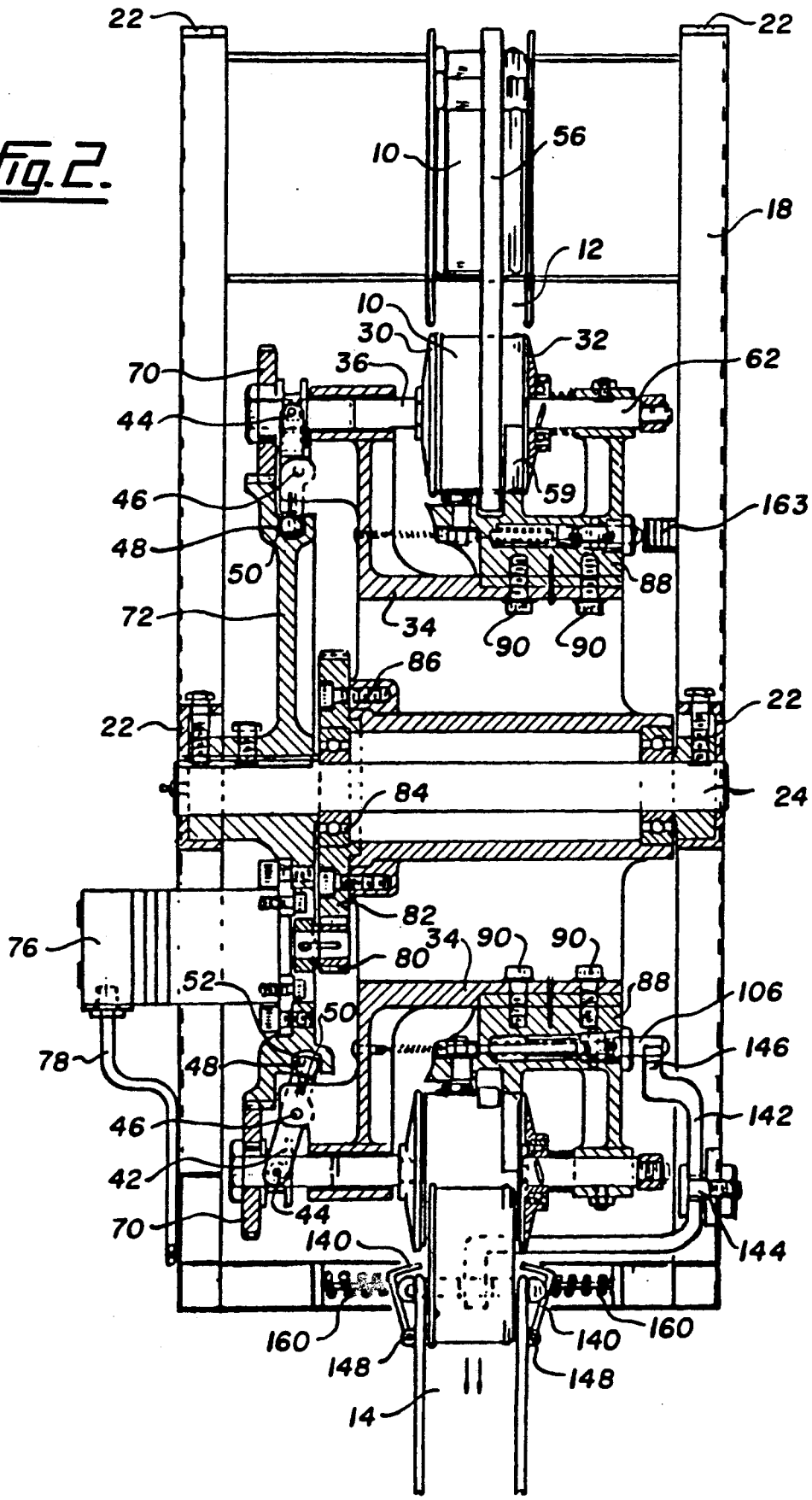
FIG. 2 is an end elevation of the apparatus of FIG. 1.
Figure 6:
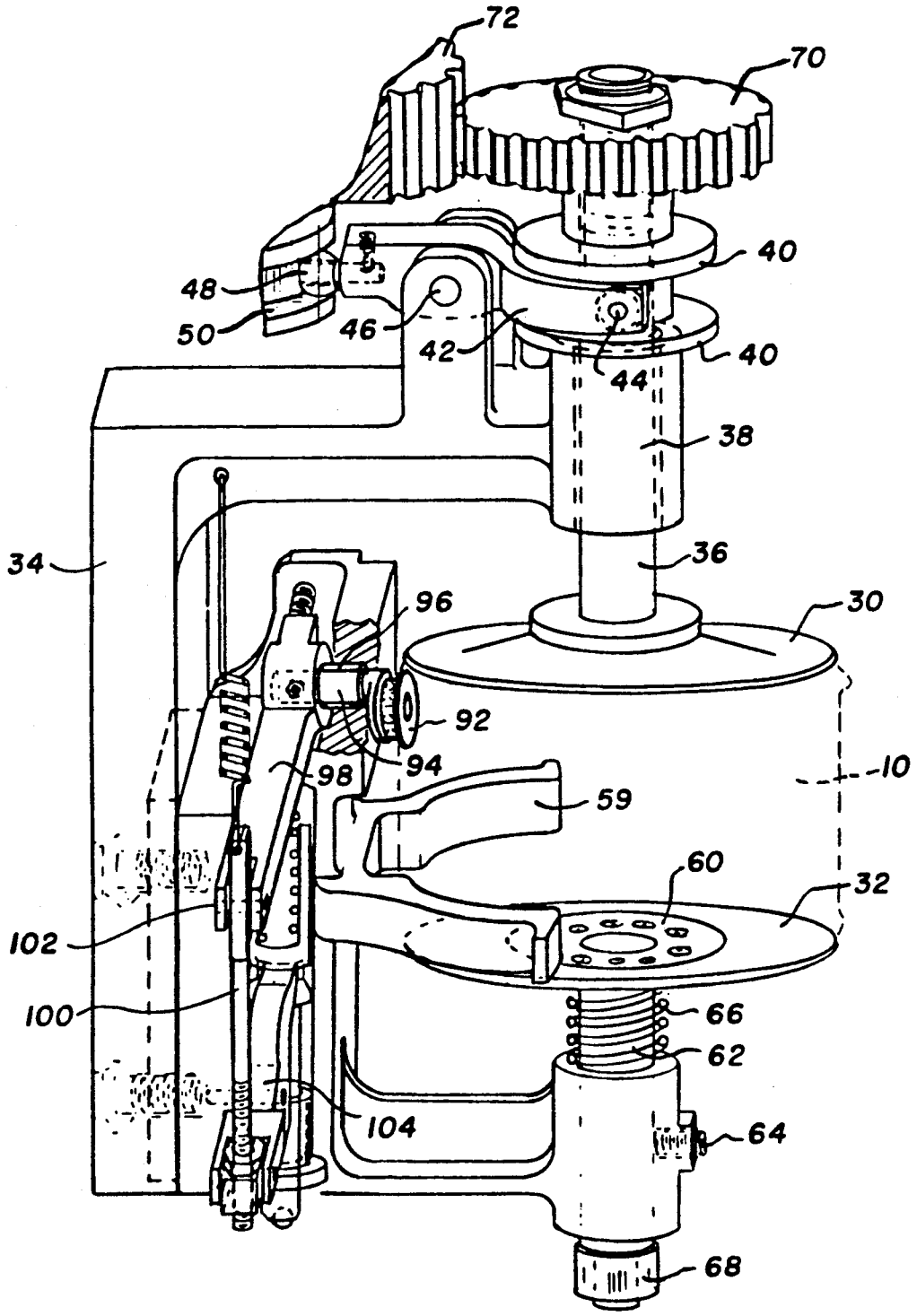
FIG. 6 is an enlarged view of the releasable holding means and the means to assess the seam of the can.

As shown in FIGS. 1, 2 and 6 there is a plurality of releasable holding means to hold cans 10 as the cans move along the pathway. A first plate 30 is urged toward a second plate 32 to grip a can 10. As shown in FIG. 6, the plates 30 are mounted on a frame 34. First plate 30 is mounted on a rod 36 slidably mounted in the frame 34 at 38. The rod 36 is formed with flanges 40 and a lever 42 is pivotally attached at 44 between the flanges 40. Lever 42 is pivotally attached to the frame 34 at 46 and there is a roller 48 at the distal end of the lever 42. A cam track 50 extends around the apparatus as shown in FIG. 2 but also as detailed in FIG. 6. The track 50 receives the rollers 48. To facilitate movement of the rollers 48 with the track 50, end roller 48 has curved edges. As shown in FIG. 2, there are deviations 52 in the track 50 adjacent the inlet 12 and the outlets 14 and 16. That is the track 50 moves to the right as viewed in FIG. 2 adjacent outlets 14 and 16. The track also deviates to the right near inlet 12 but this is not shown in FIG. 1. The roller 48 moves to follow the deviations 52 and thus moves the lever 42 to move the first plate 30 to release a can 10. The lower lever 42 shown in FIG. 2 is in the release position, the upper lever 42 is in the hold or grip position. Thus at the inlet 12 the track 52 will deviate to the right as shown in FIG. 2 as the frame 34 approaches the inlet 12. This opens the plates 30 and 32 by moving the first plate 30 away from the second 32. A can 10 then enters between the spaced plates 30 and 32. The track 50 moves upwardly as shown in FIG. 6 or to the right in FIG. 2 which acts to move the first plate 30 downwardly to grip a can 10. The inlet 12 is fed by a track 56 the inner end 58 of which extends to guide the cans 10 between the plates 30 and 32. There is also an arcuate member 59 on the frame 34, as shown in FIG. 6, that also acts to receive and steady a can 10 as it is gripped by the plates 30 and 32.

As shown in FIG. 6, the second plate 32 is mounted on a bearing 60 that can rotate on a shaft 62 fixed in the frame 34 and located by screw 64. The bearing 60 can move longitudinally of the shaft 62 and there is a spring 66 to allow movement of the bearing 60. In this way relatively minor variations in can height can be tolerated.

Shaft 62 has a roller 68 at its outer end.

The holding means, in the form of plates 30 and 32, are rotated. Lower plate 32 simply rotates on the bearing 60 but the upper plate 30 is driven. A gear wheel 70 is attached to the end of the shaft 36 remote from the first plate 30. There is a central fixed first gear wheel 72, thicker than the gear wheel 70 to ensure that the movement of gear wheel 70 does not move the gear wheel 70 out of engagement with fixed wheel 72 to prevent drive of the gear wheel 70. The arrangement is shown in FIG. 6. There is a hydraulic motor 76 having a hydraulic supply through lines 78 and a gear 80 on its output shaft. The gear 80 engages a third gear wheel 82 mounted by bearings 84 on shaft 24. The third gear wheel 82 is bolted at 86 to frame 34. Frames 88 to carry the second plates 32 and the means to asses a seam are mounted on the frame 34 by bolts 90 extending through the frame 34 to engage the frame 88.

The arrangement ensures that the gear wheels 70 are rotated as the frames 34 are moved around the fixed first gear wheel 72. The first and second plates 30 and 32, and thus the cans 10 gripped between them, are also rotated.

Figure 3:
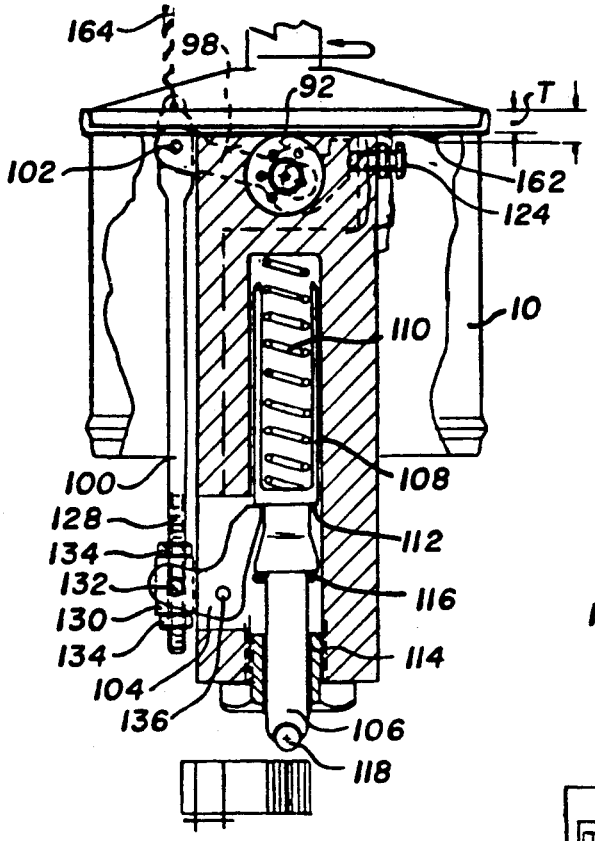
FIG. 3 is a detail of the means to assess the seam of a can.
Figure 4:
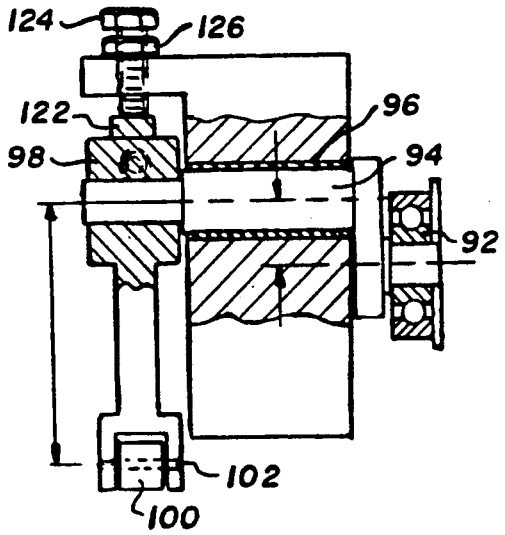
FIG. 4 is a detail of FIG. 3.

The means to assess the seam of a can 10 is shown in FIGS. 3, 4 and 6. There is a roller 92 to contact the seam of the can as shown in FIG. 3. The can 10 is rotated as it is inspected. A cam shaft 94 mounts the roller 92 and extends through an opening 96 in the frame 34. There is a lever 98 mounted on the cam shaft as shown in FIGS. 3 and 4. A rod 100 is pivotally attached to level 98 at 102. A catch 104 is pivotable by longitudinal movement of the lever 100.

A rod 106 is retained by the catch 104. The rod 106 is received in a housing 108 in the frame 34. A spring 110 urges the rod 106 outwardly of the housing 108. There is a shoulder 112 on the rod 106 to engage the catch 104. A stop 114 ensures the rod 106 is always retained by the housing 108. FIG. 3 shows that movement of the catch 104 from the shoulder 112 allows the spring 110 to urge the rod 106 out of the housing. The outward movement is restricted by the rod 106 contacting the stop 114. An O-ring 116 is provided on rod 106 to contact the stop 114. This reduces noise. A ball-bearing 118 is housed in the end of each rod 106.

The position of the roller 92 can be adjusted to assess seams of differing heights. As shown in FIGS. 3 and 4 the adjustment comprises an abutment 122 formed on the level 98. A screw 124 extends through the frame 34 to contact the abutment 122. Movement of the screw 124 in and out allows pivoting of the cam shaft 94 to move the roller 92 relative to the longitudinal axes of the can as shown in FIG. 3. Screw 124 is provided with lock nut 126.

The apparatus also includes means to vary the sensitivity of the catch 104. FIG. 3, shows a threaded portion 128 on the level 100. A collar 130 on the threaded portion 128 is pivotally attached to the catch 104 at 132. Movement of the collar 130 along the lever 100 alters the position of the catch 104 relative to the shoulder 112 to vary the sensitivity. The collar 130 slides on the thread 128 and is located by lock nuts 134 at each end. The catch 104 pivots at 136.

Figure 5:
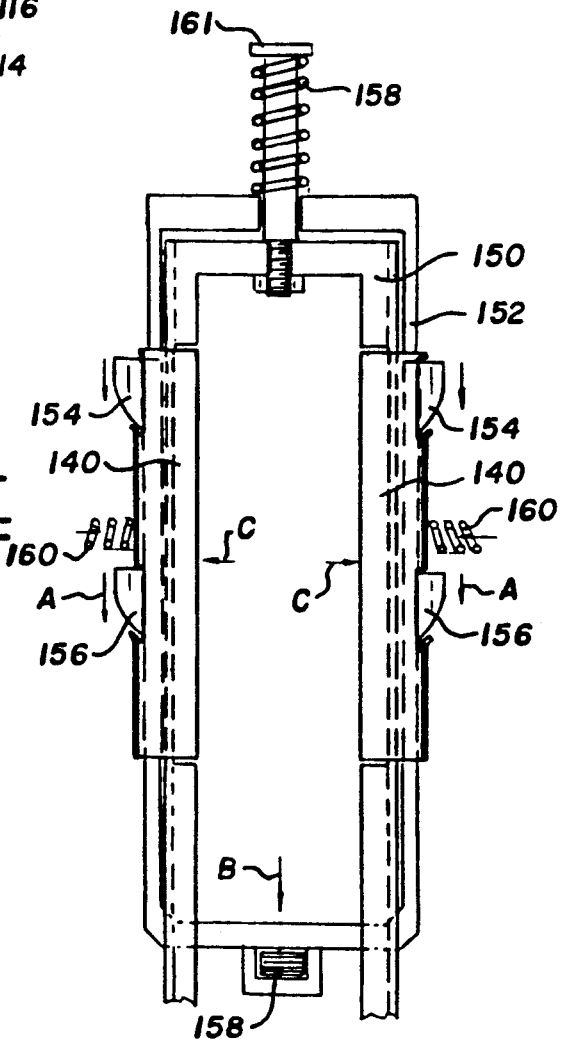
FIG. 5 shows the gate apparatus for reject cans.

The first outlet 14,—the outlet for cans having defective seams—has a gate 140 to close it. As shown in FIG. 5, when the gate 140 is closed, the position shown in FIG. 5, an acceptable can 10 can roll over the gate 140 to reach the second outlet 16. However, there is a gate actuating link 142 pivotally mounted at 144 as shown in FIG. 2. Gate actuating link 142 has a projection 146 at one end so that it contacts a projecting rod 106. Movement of the gate actuating link 142 by contact with projecting rod 106 acts to open the gate 140. To this end, the gate comprises opposed gate members, each hingedly mounted at 148 as shown in FIG. 2. There is an inner frame 150 and an outer frame 152 between the gate members. There are projections 154 on the outer frame 156, two are shown on each side of the frame in FIG. 5, but one on each side will suffice. There are openings 156 in the gate members and the projections 154 extend through those openings when the gate is closed. The gate actuating link extends to engage a catch member 158 on the outer frame 152 as shown in FIGS. 2 and 5. Thus when the gate actuating link 142 is moved, the frame 152 is moved in the direction of arrows A. The gate 140 is not mounted on the outer frame member 152 and the projections 154 therefore move under gate 140 to open the gate 140 as shown in FIG. 2.

There are resilient means in the form of springs 160 mounted in the frame 18 to urge the gate 140 closed. Similarly there is a spring 158 linking the inner and outer frames 150 and 152 in the mounted on a shaft 161 attached to the inner frame 150. This mechanism returns the relative positions to the inner and outer frames 150 and 152 thus ensuring alignment of the openings 156 with the projections 154 and the closing of the gate members.

There is a generally semi-circular projection 163 positioned on one frame member 18 between second outlet 16 and the inlet 12—see FIG. 2.

The apparatus functions as follows:

Drive is provided by the motor 76 turning the frame 34 around the periphery of the fixed wheel 72 to rotate the gear wheels 70 and thus the first plates 30. The supply of cans is through the track 56 to the inlet 12 controlled by gate 26 as described above. Roller 68 acts to contact the lever 28.

When the apparatus is in use, gate 26 feeds cans 10 sequentially between opposed plates 30 and 32 which have been separated immediately prior to the inlet 12 by an appropriate deviation of the channel 50 engaged by a roller 48. Thus as the plates 30 and 32 are immediately adjacent the inlet a can 10 is allowed to pass by the gate 26. The shaping at 58 of the channel 56 and the retaining member 59 ensure that the can is properly located between a pair of plates 30 and 32 on a frame 34. The channel 50 then changes direction. The plate 30 is moved towards plate 32 by the roller 48 following the channel 50 to move the lever 42 to direct the plate 30 inwardly as shown in FIG. 2. Plate 30 is constantly rotated. Therefore, as soon as a can 10 is gripped between the plates 30 and 32, the can is rotated by its contact with the plate 30. Plates 32 idle on bearing 60. As the can 10 is rotated it is rotated in contact with the roller 92. In general a can is rotated about 3 times between the inlet 12 and the first outlet 14.

Assuming first that the can is unacceptable, that is that is has a defective seam as shown at projection 162 in FIG. 3 that is the thickness T of an acceptable seam is extended by the projection 162, then the roller 92 is moved downwardly. A slight downward movement of roller 92 is greatly exaggerated by the cam shaft 94 and the lever 98. Lever 100 therefore moves downwardly as shown in FIG. 3. Catch 104 is pivoted around pivot point 136 and moves out of engagement with the shoulder 112 on rod 106. Spring 110 then urges the rod 106 out of the housing 108. This might happen very shortly after the inlet 12 but, in the event that the roller 92 does not properly detect a projection 162 at the first opportunity, then it is certain it will detect it on the second or third rotation and the rod 106 will then be projected as described above.

Projecting rod 106 strikes projection 146 of the gate actuating lever 142, pivoting the lever about pivot 144. Gate actuating link 142 is engaged with bracket 158 on outer frame 152. It therefore moves the frame 152 in the direction of arrow B as shown in FIG. 5 forcing the two members making up the gate 140 to move in the direction of arrow C in FIG. 5. Thus as a pair of plates 30 and 32 carrying a defective can approaches the outlets 14 and 16, track 50 deviates to separate the plates 30 and 32 as described for the inlet 12 above. The can is released. Because the can 10 is defective rod 106 has actuated gate actuating link 142 to open gate 140. Therefore the can rolling from the plates 30 and 32 can pass down the first inlet 14 and does so. It is rejected. The can is opened and the contents removed. Because the apparatus is in the canning line the contents may be re-canned.

As soon as rod 106 ceases to contact projection 146 of gate actuating link 142, springs 160 and 158 return the inner and outer frames 150 and 152 and the gate 140 to the positions shown in FIG. 5.

Assuming, as is almost certain to be the case, the next can is acceptable, then as it approaches the outlet 14 rod 106 will be retracted. It will *not* contact the projection 146 and gate 140 will not, therefore, be opened. The can will be released by the deviation 52 and the track 50 acting to separate the plates 30 and 32 but the acceptable can will roll across gate 140 through outlet 16.

Any projecting rod 106 contacts circular projection 163 on the frame immediately prior to the inlet 12 and the rod 106 is thus returned to the housing 108. A small spring 164 acts to pull lever 100 upwardly to ensure that the catch re-engages the rod 106 to retain it in position until a defective can triggers the mechanism. The apparatus of the present invention is capable of scanning up to 600 cans per minute with an accuracy of 100%.

The apparatus is durable. It is entirely mechanical. The hydraulic motor 76 is able to operate in extremely adverse conditions. The use of a hydraulic motor gives excellent speed control and, by the use of solenoid flow control valves, can provide effective safety stops in the event of malfunction or objects being dropped in to the apparatus.

I claim:

1. A can seam inspection apparatus comprising:

a pathway for a can, the pathway having an inlet and a pair of outlets comprising a first outlet for cans with a defective seam and a second outlet for acceptable cans;

a plurality of releasable holding means to hold cans as the cans move along the pathway;

means to rotate the holding means and thus the cans as they move along the pathway;

releasable means to release the holding means adjacent the inlet and adjacent the outlets;

means to assess the seam of a can as the can rotates comprising a roller to contact the seam as the can is rotated, a cam shaft mounting the roller, a lever contacting the cam shaft, a catch operable by longitudinal movement of the lever, a rod retained by the catch, whereby movement of the roller on contacting a seam defect operates the catch to release the rod, the rod acting to trigger a mechanism to open the first outlet.

2. Apparatus as claimed in claim 1 in which the rod is received in a housing;

resilient means to urge the rod outwardly of the housing;

an abutment on the rod to engage the catch, movement of the catch from the abutment allowing the resilient means to urge the rod outwardly of the housing.

3. Apparatus as claimed in claim 2 including a stop to ensure the rod is always retained by the housing.

4. Apparatus as claimed in claim 1 including means to adjust the position of the roller to asses seams of differing heights.

5. Apparatus as claimed in claim 4 in which the means comprises an abutment on the lever;

a screw to contact the abutment whereby movement of the screw in and out allows pivoting of the cam shaft to move the roller.

6. Apparatus as claimed in claim 1 including means to vary the sensitivity of the catch.

7. Apparatus as claimed in claim 6 in which the means to vary the sensitivity comprises a threaded portion on the lever;

a collar on the threaded portion pivotally attached to the catch;

whereby movement of the collar along the rod alters the position of the catch relative to the abutment to vary the sensitivity.

8. Apparatus as claimed in claim 1 in which the first outlet has a gate to close it, over which gate an acceptable can rolls to reach the second outlet;

a gate actuating link on the apparatus adjacent the first outlet where the released rod can contact it;

movement of the gate actuating link by contact with the released rod acting to open the gate.

9. Apparatus as claimed in claim 8 in which the gate comprises opposed gate members, hingedly mounted;

at least one opening in each gate member;

an inner frame and an outer frame between the opposed gate members;

projections on the outer frame, each projection to extend through an opening in each gate member;

the gate actuating link being attached to the outer frame to move the frame whereby the projections move under the gate members to move the gate members outwardly about their hinges.

10. Apparatus as claimed in claim 9 including resilient means urging the gate member to the closed position.

11. Apparatus as claimed in claim 9 including resilient means linking the inner and outer frames and tending to move the inner frame so that said projections are aligned with said openings in the gate members.

12. A cam seam inspection apparatus comprising:

a pathway for a can, the pathway having an inlet and a pair of outlets comprising a first outlet for cans with a defective seam and a second outlet for acceptable cans;

a plurality of releasable holding means to hold cans as the cans move along the pathway;

the inlet being controlled to permit the orderly passage of one can in time with the arrival of a releasable holding means to the can, said inlet being controlled by a gate projecting into the inlet;

resilient means urging the gate to a position where it blocks the inlet;

a lever extending from the gate to contact a releasable holding means as it approaches the inlet whereby the lever contacts the releasable holding means to retract the gate to allow a can to be received by the releasable holding means;

means to rotate the holding means and thus the cans as they move along the pathway;

releasable means to release the holding means adjacent the inlet and adjacent the outlets;

means to assess the seam of a can as the can rotates; and means to open the first outlet when the seam is found defective.

13. A can seam inspection apparatus comprising;

a pathway for a can, the pathway having an inlet and a pair of outlets comprising a first outlet for cans with a defective seam and a second outlet for acceptable cans;

a plurality of releasable holding means to hold cans as the cans move along the pathway;

means to rotate the holding means and thus the cans as the cans move along the pathway, said means comprising a central, fixed first gear wheel, a rotatable second gear wheel attached to each holding means to engage the first gear wheel whereby the holding means is rotated with the second gear wheel as the holding means moves around the first gear wheel;

releasable means to release the holding means adjacent the inlet and adjacent the outlets;

means to assess the seam of a can as the can rotates; and means to open the first outlet when the seam is found defective.

14. A can seam inspection apparatus comprising:

a pathway for a can, the pathway having an inlet and a pair of outlets comprising a first outlet for cans with a defective seam and a second outlet for acceptable cans;

a plurality of releasable holding means to hold cans as the cans move along the pathway, said releasable holding means comprising opposed plates, a first plate being urged towards a second plate to grip a can, the opposed plates each being mounted on a frame with the first plate mounted on a rod slidably mounted in the frame, a lever to contact the rod at one end of the lever, a roller at the distal end of the lever, a track extending around the apparatus to receive the roller and deviations in the track whereby the roller moves to follow the deviations and thus to move the lever to move the first plate to grip or release a can;

the second plate being mounted on a bearing, the bearing being mounted on a shaft fixed in the frame and resilient means on the shaft abutting the bearing to allow slight movement of the bearing and thus the second plate on the shaft to allow for slight differences in can height;

means to rotate the holding means and thus the cans as they move along the pathway;

releasable means to release the holding means adjacent the inlet and adjacent the outlets;

means to assess the seam of a can as the can rotates; and means to open the first outlet when the seam is found detective.

* * * * *